US009188337B2

(12) United States Patent
Stoia et al.

(10) Patent No.: US 9,188,337 B2
(45) Date of Patent: Nov. 17, 2015

(54) SYSTEM AND METHOD FOR SUPPLYING A WORKING FLUID TO A COMBUSTOR VIA A NON-UNIFORM DISTRIBUTION MANIFOLD

(75) Inventors: Lucas John Stoia, Taylors, SC (US); Patrick Benedict Melton, Horse Shoe, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 838 days.

(21) Appl. No.: 13/349,906

(22) Filed: Jan. 13, 2012

(65) Prior Publication Data

US 2013/0180254 A1 Jul. 18, 2013

(51) Int. Cl.

| | |
|---|---|
| ***F23R 3/06*** | (2006.01) |
| ***F23R 3/00*** | (2006.01) |
| ***F23R 3/28*** | (2006.01) |
| ***F23R 3/34*** | (2006.01) |

(52) U.S. Cl.

CPC . *F23R 3/005* (2013.01); *F23R 3/06* (2013.01); *F23R 3/283* (2013.01); *F23R 3/34* (2013.01); *F23R 2900/03043* (2013.01)

(58) Field of Classification Search

CPC .... F23R 3/06; F23R 3/34; F23R 2900/03043; F23R 3/26

USPC ..... 60/733, 739, 740, 746, 772

See application file for complete search history.

(56) References Cited

U.S. PATENT DOCUMENTS

| | | | |
|---|---|---|---|
| 2,922,279 | A | 1/1960 | Roberson et al. |
| 3,934,409 | A | 1/1976 | Quillevere et al. |
| 4,040,252 | A | 8/1977 | Mosier et al. |
| 4,045,956 | A | 9/1977 | Markowski et al. |
| 4,112,676 | A | 9/1978 | DeCorso |

(Continued)

FOREIGN PATENT DOCUMENTS

| | | |
|---|---|---|
| EP | 2236935 | 6/2010 |
| EP | 2206964 A2 | 7/2012 |

(Continued)

OTHER PUBLICATIONS

Air Distribution System Design, Office of Energy Efficiency and Renewable Energy, US. Department of Energy, Mar. 2003, pp. 1-6.*

(Continued)

*Primary Examiner* — William H Rodriguez
*Assistant Examiner* — Lorne Meade
(74) *Attorney, Agent, or Firm* — Dority & Manning, PA

(57) ABSTRACT

A system for supplying a working fluid to a combustor includes a fuel nozzle and a combustion chamber downstream from the fuel nozzle. A flow sleeve circumferentially surrounds the combustion chamber, and fuel injectors provide fluid communication to the combustion chamber. A distribution manifold circumferentially surrounds the fuel injectors and defines an annular plenum. A fluid passage through the distribution manifold provides fluid communication through the distribution manifold. A radial cross-sectional area of the annular plenum varies around the flow sleeve. A method for supplying a working fluid to a combustor includes flowing a working fluid through a combustion chamber, diverting a portion of the working fluid through a distribution manifold that circumferentially surrounds fuel injectors circumferentially arranged around the combustion chamber, and changing at least one of a pressure or flow rate of the diverted portion of the working fluid.

10 Claims, 5 Drawing Sheets

(56) References Cited

U.S. PATENT DOCUMENTS

| | | | | |
|---|---|---|---|---|
| 4,253,301 | A | 3/1981 | Vogt | |
| 4,288,980 | A | 9/1981 | Ernst | |
| 4,402,184 | A * | 9/1983 | Faulkner et al. | 60/739 |
| 4,704,869 | A | 11/1987 | Iizuka et al. | |
| 4,928,481 | A | 5/1990 | Joshi et al. | |
| 5,054,280 | A | 10/1991 | Ishibashi et al. | |
| 5,099,644 | A | 3/1992 | Sabla et al. | |
| 5,127,229 | A | 7/1992 | Ishibashi et al. | |
| 5,297,391 | A | 3/1994 | Roche | |
| 5,321,948 | A | 6/1994 | Leonard | |
| 5,450,725 | A | 9/1995 | Takahara et al. | |
| 5,623,819 | A | 4/1997 | Bowker et al. | |
| 5,749,219 | A | 5/1998 | DuBell | |
| 5,927,066 | A * | 7/1999 | Shekleton et al. | 60/804 |
| 5,974,781 | A | 11/1999 | Correa et al. | |
| 6,047,550 | A * | 4/2000 | Beebe | 60/737 |
| 6,178,737 | B1 | 1/2001 | Lenertz et al. | |
| 6,192,688 | B1 | 2/2001 | Beebe | |
| 6,253,538 | B1 | 7/2001 | Sampath et al. | |
| 6,305,155 | B1 * | 10/2001 | Gross | 60/782 |
| 6,868,676 | B1 * | 3/2005 | Haynes | 60/776 |
| 6,925,809 | B2 | 8/2005 | Mowill | |
| 6,935,116 | B2 | 8/2005 | Stuttaford et al. | |
| 7,137,256 | B1 | 11/2006 | Stuttaford et al. | |
| 7,162,875 | B2 | 1/2007 | Fletcher et al. | |
| 7,237,384 | B2 | 7/2007 | Stuttaford et al. | |
| 7,425,127 | B2 | 9/2008 | Zinn | |
| 7,665,309 | B2 | 2/2010 | Parker et al. | |
| 8,475,160 | B2 | 7/2013 | Campbell et al. | |
| 2005/0095542 | A1 | 5/2005 | Sanders et al. | |
| 2005/0097889 | A1 | 5/2005 | Pilatis et al. | |
| 2007/0022758 | A1 | 2/2007 | Myers et al. | |
| 2007/0137207 | A1 | 6/2007 | Mancini et al. | |
| 2009/0084082 | A1 | 4/2009 | Martin et al. | |
| 2010/0018208 | A1 | 1/2010 | Ritland | |
| 2010/0018209 | A1 | 1/2010 | Ramier et al. | |
| 2010/0170216 | A1 * | 7/2010 | Venkataraman et al. | 60/39.37 |
| 2010/0174466 | A1 | 7/2010 | Davis, Jr. et al. | |
| 2011/0056206 | A1 | 3/2011 | Wiebe | |
| 2011/0067402 | A1 | 3/2011 | Wiebe et al. | |
| 2011/0131998 | A1 | 6/2011 | Nadkarni et al. | |
| 2011/0179803 | A1 | 7/2011 | Berry et al. | |
| 2011/0296839 | A1 | 12/2011 | Van Nieuwenhuizen et al. | |
| 2013/0008169 | A1 | 1/2013 | Belsom et al. | |

FOREIGN PATENT DOCUMENTS

| | | |
|---|---|---|
| EP | 2613082 | 10/2013 |
| JP | 2006138566 | 6/2006 |
| WO | WO 2004/035187 A2 | 4/2004 |

OTHER PUBLICATIONS

Co-pending U.S. Appl. No. 13/466,184, Melton, et al., filed May 8, 2012.

Co-pending U.S. Appl. No. 13/349,886, Stoia, et al., filed Jan. 13, 2012.

Co-pending U.S. Appl. No. 13/344,877, Stoia, et al., filed Jan. 6, 2012.

Co-pending U.S. Appl. No. 13/420,715, Chen, et al., filed Mar. 15, 2012.

Co-pending U.S. Appl. No. 13/455,429, Romig, et al., filed Apr. 25, 2012.

Co-pending U.S. Appl. No. 13/455,480, Stoia, et al., filed Apr. 25, 2012.

Co-pending U.S. Appl. No. 14/122,694, Shershnyov, filed Nov. 27, 2013.

Co-pending U.S. Appl. No. 14/122,697, Shershnyov, filed Nov. 27, 2013.

Co-pending U.S. Appl. No. 13/417,405, Chen et al., filed Mar. 12, 2012.

English Abstract of JPS60147542 (A) dated Aug. 3, 1985, 2 pages.

English Abstract Translation of ITMI930830, dated May 23, 1994, 1 page.

European Search Report for Application No. 13151067.9-1605 / 2615372 dated Jun. 16, 2015.

* cited by examiner

SYSTEM AND METHOD FOR SUPPLYING A WORKING FLUID TO A COMBUSTOR VIA A NON-UNIFORM DISTRIBUTION MANIFOLD

FIELD OF THE INVENTION

The present invention generally involves a system and method for supplying a working fluid to a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, one or more fuel injectors, also known as late lean injectors, may be circumferentially arranged around the combustion chamber downstream from the nozzles. A portion of the compressed working fluid exiting the compressor may flow through the fuel injectors to mix with fuel to produce a lean fuel-air mixture. The lean fuel-air mixture may then be injected into the combustion chamber for additional combustion to raise the combustion gas temperature and increase the thermodynamic efficiency of the combustor.

The late lean injectors are effective at increasing combustion gas temperatures without producing a corresponding increase in the production of $NO_X$. However, the pressure and flow of the compressed working fluid exiting the compressor may vary substantially around the circumference of the combustion chamber. As a result, the fuel-air ratio flowing through the late lean injectors can vary considerably, mitigating the beneficial effects otherwise created by the late lean injection of fuel into the combustion chamber. Previous attempts have been made to achieve a more uniform flow of working fluid through the late lean injectors. For example, scoops or shrouds have been installed over a portion of the fuel injectors to more evenly regulate the flow of working fluid through the fuel injectors. However, an improved system and method for reducing the variation in the pressure and/or flow of the working fluid flowing through the late lean injectors would be useful.

BRIEF DESCRIPTION OF THE INVENTION

Aspects and advantages of the invention are set forth below in the following description, or may be obvious from the description, or may be learned through practice of the invention.

One embodiment of the present invention is a system for supplying a working fluid to a combustor that includes a fuel nozzle and a combustion chamber downstream from the fuel nozzle. A flow sleeve circumferentially surrounds the combustion chamber, and a plurality of fuel injectors circumferentially arranged around the flow sleeve provides fluid communication through the flow sleeve to the combustion chamber. A distribution manifold circumferentially surrounds the plurality of fuel injectors and defines an annular plenum between the distribution manifold and the flow sleeve. A fluid passage through the distribution manifold provides fluid communication through the distribution manifold to the annular plenum. A radial cross-sectional area of the annular plenum varies around the flow sleeve.

Another embodiment of the present invention is a system for supplying a working fluid to a combustor that includes a combustion chamber, a liner that circumferentially surrounds the combustion chamber, and a flow sleeve that circumferentially surrounds the liner. A distribution manifold circumferentially surrounds the flow sleeve and defines an annular plenum between the distribution manifold and the flow sleeve. A plurality of fuel injectors circumferentially arranged around the flow sleeve provides fluid communication through the flow sleeve and the liner to the combustion chamber. A fluid passage through the distribution manifold provides fluid communication through the distribution manifold to the plurality of fuel injectors. A radial cross-sectional area of the annular plenum varies around the flow sleeve.

The present invention may also include a method for supplying a working fluid to a combustor. The method includes flowing a working fluid from a compressor through a combustion chamber, diverting a portion of the working fluid through a distribution manifold that circumferentially surrounds a plurality of fuel injectors circumferentially arranged around the combustion chamber, and changing at least one of a pressure or flow rate of the diverted portion of the working fluid.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
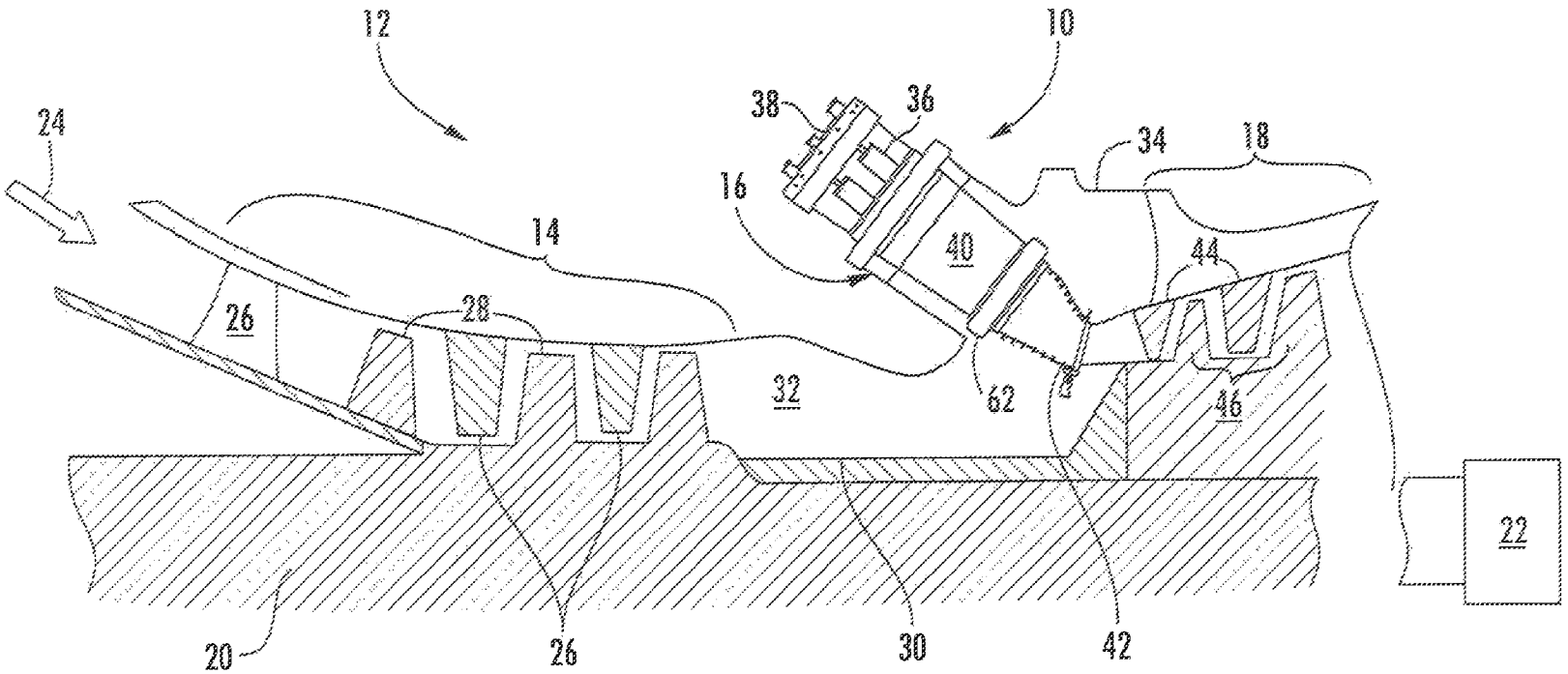
FIG. 1 is a simplified side cross-section view of a system according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for supplying a working fluid to a combustor. In general, the system includes multiple late lean injectors that circumferentially surround a combustion chamber. The system diverts or flows a portion of the working fluid through a distribution manifold that circumferentially surrounds the late lean injectors. The distribution manifold defines a radial cross-sectional area around the combustion chamber that varies to change the flow rate of the working fluid inside the distribution manifold. As a result, the system reduces variations in the pressure and/or flow rate of the working fluid flowing through each late lean injector to produce a more uniform fuel-air mixture injected into the combustion chamber. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section view of a system 10 according to one embodiment of the present invention. As shown, the system 10 may be incorporated into a gas turbine 12 having a compressor 14 at the front, one or more combustors 16 radially disposed around the middle, and a turbine 18 at the rear. The compressor 14 and the turbine 18 typically share a common rotor 20 connected to a generator 22 to produce electricity.

The compressor 14 may be an axial flow compressor in which a working fluid 24, such as ambient air, enters the compressor 14 and passes through alternating stages of stationary vanes 26 and rotating blades 28. A compressor casing 30 contains the working fluid 24 as the stationary vanes 26 and rotating blades 28 accelerate and redirect the working fluid 24 to produce a continuous flow of compressed working fluid 24. The majority of the compressed working fluid 24 flows through a compressor discharge plenum 32 to the combustor 16.

The combustor 16 may be any type of combustor known in the art. For example, as shown in FIG. 1, a combustor casing 34 may circumferentially surround some or all of the combustor 16 to contain the compressed working fluid 24 flowing from the compressor 14. One or more fuel nozzles 36 may be radially arranged in an end cover 38 to supply fuel to a combustion chamber 40 downstream from the fuel nozzles 36. Possible fuels include, for example, one or more of blast furnace gas, coke oven gas, natural gas, vaporized liquefied natural gas (LNG), hydrogen, and propane. The compressed working fluid 24 may flow from the compressor discharge plenum 32 along the outside of the combustion chamber 40 before reaching the end cover 38 and reversing direction to flow through the fuel nozzles 36 to mix with the fuel. The mixture of fuel and compressed working fluid 24 flows into the combustion chamber 40 where it ignites to generate combustion gases having a high temperature and pressure. The combustion gases flow through a transition piece 42 to the turbine 18.

The turbine 18 may include alternating stages of stators 44 and rotating buckets 46. The first stage of stators 44 redirects and focuses the combustion gases onto the first stage of turbine buckets 46. As the combustion gases pass over the first stage of turbine buckets 46, the combustion gases expand, causing the turbine buckets 46 and rotor 20 to rotate. The combustion gases then flow to the next stage of stators 44 which redirects the combustion gases to the next stage of rotating turbine buckets 46, and the process repeats for the following stages.

Figure 2:
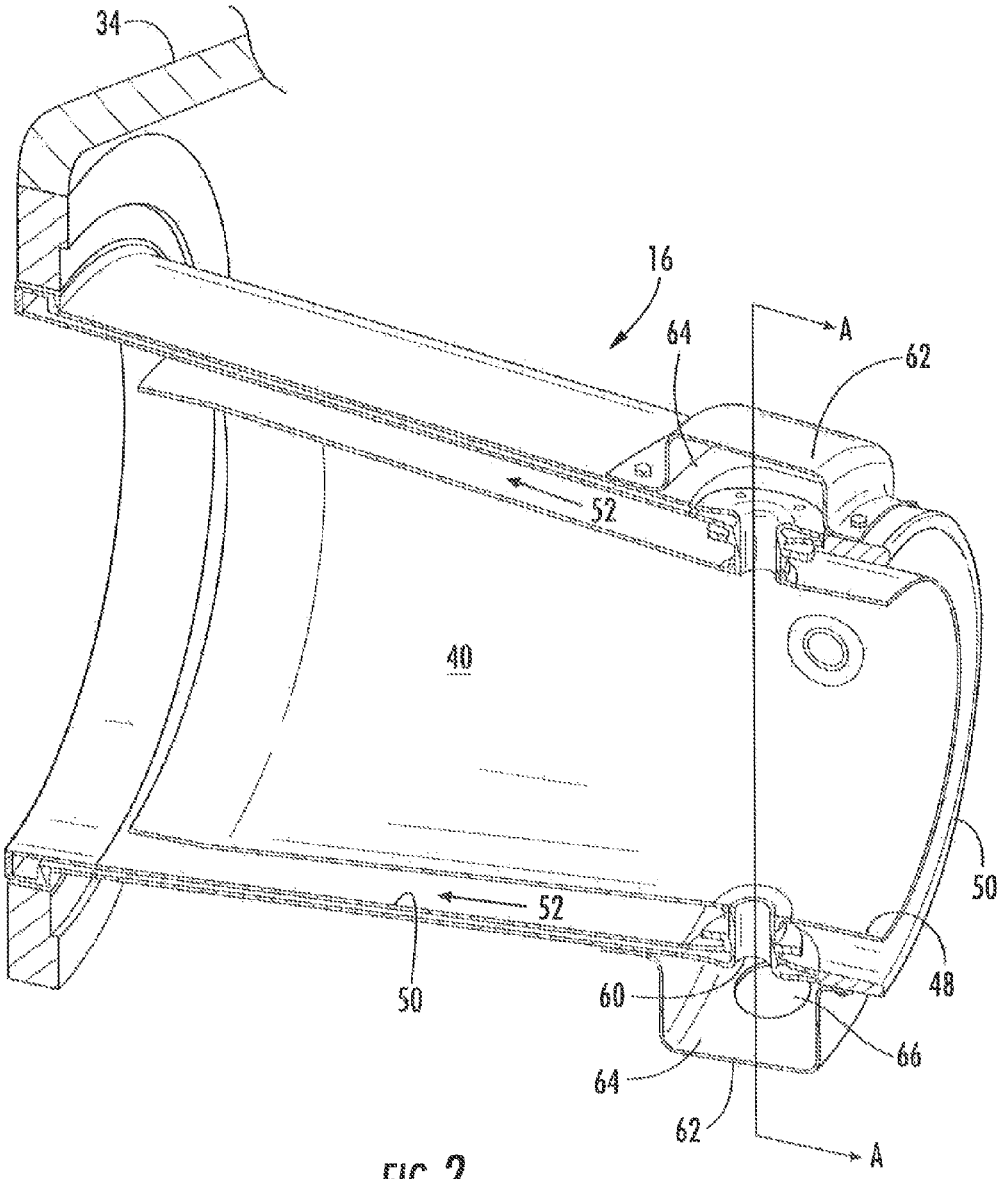
FIG. 2 is a simplified side cross-section view of a portion of the combustor shown in FIG. 1 according to a first embodiment of the present invention.

FIG. 2 provides a simplified side cross-section view of a portion of the combustor 16 shown in FIG. 1 according to a first embodiment of the present invention. As shown, the combustor 16 may include a liner 48 that circumferentially surrounds at least a portion of the combustion chamber 40, and a flow sleeve 50 may circumferentially surround the liner 48 to define an annular passage 52 that surrounds the liner 48. In this manner, the compressed working fluid 24 from the compressor discharge plenum 32 may flow through the annular passaged 52 along the outside of the liner 48 to provide convective cooling to the liner 48 before reversing direction to flow through the fuel nozzles 36 (shown in FIG. 1) and into the combustion chamber 40.

The combustor 16 may further include a plurality of fuel injectors 60 circumferentially arranged around the combustion chamber 40, liner 48, and flow sleeve 50 downstream from the fuel nozzles 36. The fuel injectors 60 provide fluid communication through the liner 48 and the flow sleeve 50 and into the combustion chamber 40. The fuel injectors 60 may receive the same or a different fuel than supplied to the fuel nozzles 36 and mix the fuel with a portion of the compressed working fluid 24 before or while injecting the mixture into the combustion chamber 40. In this manner, the fuel injectors 60 may supply a lean mixture of fuel and compressed working fluid 24 for additional combustion to raise the temperature, and thus the efficiency, of the combustor 16.

A distribution manifold 62 circumferentially surrounds the fuel injectors 60 to shield the fuel injectors 60 from direct impingement by the compressed working fluid 24 flowing out of the compressor 14. The distribution manifold 62 may extend axially along the entire length of the flow sleeve 50 or less than approximately 75%, 50%, or 25% of an axial length of the flow sleeve 50, as shown in FIG. 2. The distribution manifold 62 may be press fit or otherwise connected to the combustor casing 34 and/or around a circumference of the flow sleeve 50 to provide a substantially enclosed volume or annular plenum 64 between the distribution manifold 62 and the flow sleeve 50. One or more fluid passages 66 through the distribution manifold 62 may provide fluid communication through the distribution manifold 62 to the annular plenum 64 between the distribution manifold 62 and the flow sleeve 50. The fluid passages 66 may be circumferentially off-set from the fuel injectors 60 to allow the compressed working fluid 24 to more evenly disperse inside the annular plenum 64 before flowing through the fuel injectors 60.

Figure 3:
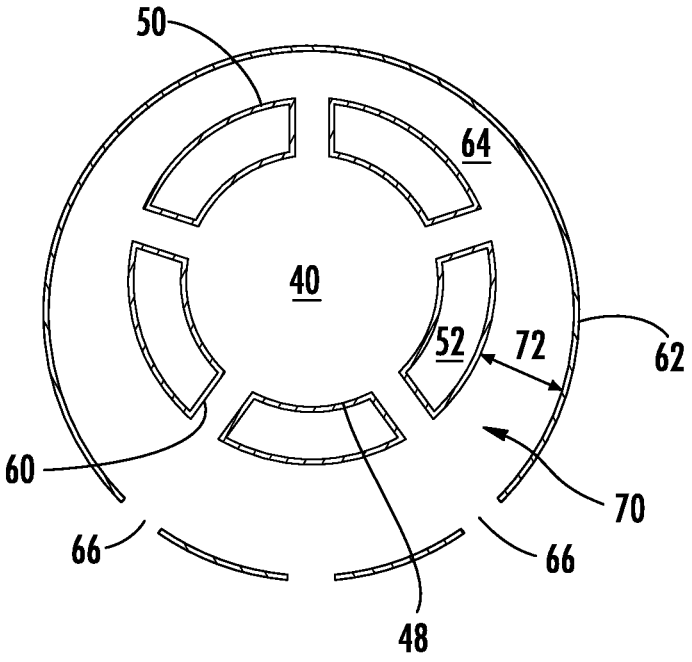
FIG. 3 is an axial cross-section view of the combustor shown in FIG. 2 taken along line A-A.

FIG. 3 provides an axial cross-section view of the combustor shown in FIG. 2 taken along line A-A. As shown in FIG. 3, the annular plenum 64 has a radial cross-sectional area 70 that varies around the flow sleeve 50. In this particular embodiment, for example, the annular plenum 64 has a radial length 72 between the distribution manifold 62 and the flow sleeve 50, and the radial length 72 varies around the flow sleeve 50 to produce a corresponding variation in the radial cross-sectional area 70 of the annular plenum 64. The variation in the radial length 72 between distribution manifold 62 and the flow sleeve 50 may be constant or varying, depending on the particular design needs with respect to the pressure and/or flow rate of compressed working fluid 24 flowing through the annular plenum 64. In addition, the fluid passages 66 are spaced at different intervals circumferentially around the distribution manifold 62, and the radial length 72, and thus the radial cross-sectional area 70, is greatest proximate to the fluid passages 66. As the compressed working fluid 24 flows through the fluid passages 66 and into the annular plenum 64, the pressure decreases and the flow rate increases as the compressed working fluid 24 flows around the flow sleeve 50 inside the annular plenum 64. As a result, variations in the pressure and/or flow rate of the working fluid 24 reaching the fuel injectors 60 are reduced to produce a more uniform fuel-air mixture injected into the combustion chamber 40.

Figure 4:
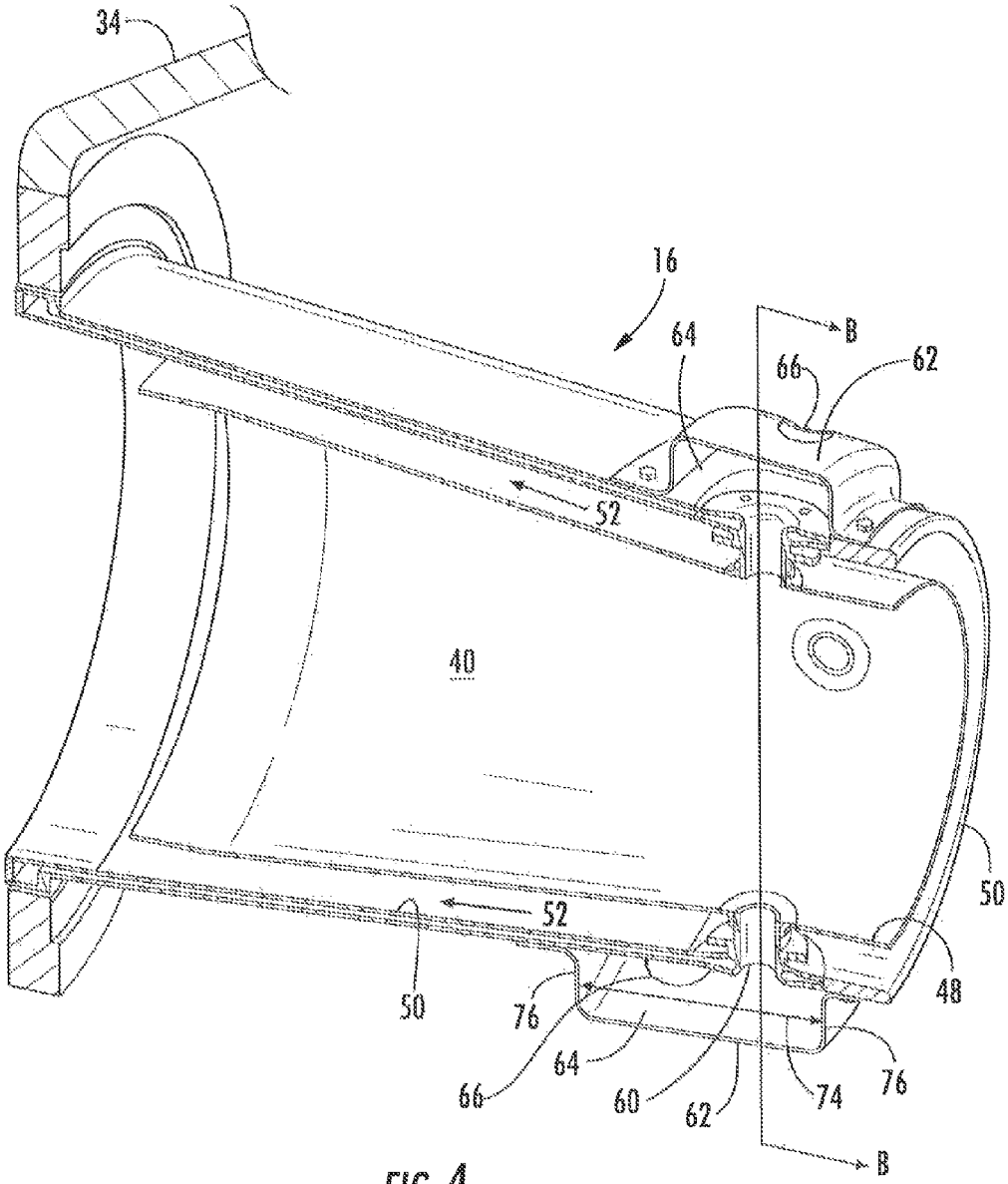
FIG. 4 is a simplified side cross-section view of a portion of the combustor 16 shown in FIG. 1 according to a second embodiment of the present invention.
Figure 5:
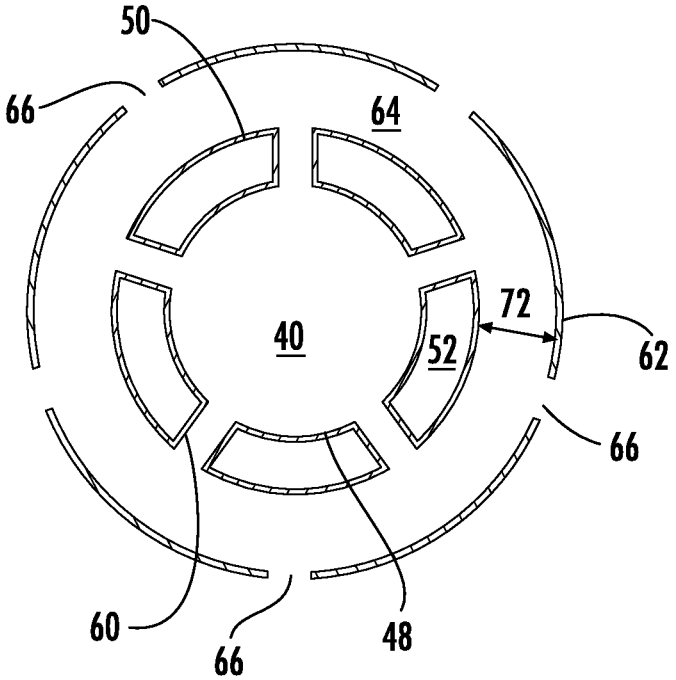
FIG. 5 is an axial cross-section view of the combustor shown in FIG. 4 taken along line B-B.

FIG. 4 provides a simplified side cross-section view of a portion of the combustor 16 shown in FIG. 1 according to a second embodiment of the present invention, and FIG. 5 provides an axial cross-section view of the combustor shown in FIG. 4 taken along line B-B. As shown, the combustor 16 again includes the liner 48, flow sleeve 50, annular passage 52, fuel injectors 60, distribution manifold 62, annular plenum 64, and fluid passages 66 as previously described with respect to the embodiment shown in FIG. 2. In this particular embodiment, the fluid passages 66 are evenly spaced around the flow sleeve 50, and the radial length 72 between the distribution manifold 62 and the flow sleeve 50 is relatively constant circumferentially around the distribution manifold 62, as shown most clearly in FIG. 5. However, as shown most clearly in FIG. 4, the annular plenum 64 has an axial width 74 between opposing sides 76 of the distribution manifold 62 that varies around the flow sleeve 50. The variation in the axial width 74 between opposing sides 76 of the distribution manifold 62 may be constant or varying, depending on the particular design needs with respect to the pressure and/or flow rate of compressed working fluid 24 flowing through the annular plenum 64. In addition, fluid passages 66 may be axially off-set from the fuel injectors 60 to allow the compressed working fluid 24 to more evenly disperse inside the annular plenum 64. As the compressed working fluid 24 flows through the fluid passages 66 and into the annular plenum 64, the change in the axial width 74 around the flow sleeve 50 changes the pressure and/or flow rate of the compressed working fluid 24 flowing around the flow sleeve 50 inside the annular plenum 64. As a result, variations in the pressure and/or flow rate of the working fluid 24 reaching the fuel injectors 60 are reduced to produce a more uniform fuel-air mixture injected into the combustion chamber 40.

The system 10 shown and described with respect to FIGS. 1-5 may also provide a method for supplying the working fluid 24 to the combustor 16. The method may include flowing the working fluid 24 from the compressor 14 through a combustion chamber 40, diverting a portion of the working fluid 24 through a distribution manifold 62 that circumferentially surrounds a plurality of fuel injectors 60 circumferentially arranged around the combustion chamber 40, and changing the pressure and/or flow rate of the diverted portion of the working fluid 24. In particular embodiments, the changing step may include flowing the diverted portion of the working fluid 24 through a narrower portion of the distribution manifold 62 and/or distributing the diverted portion of the working fluid 24 substantially evenly around the combustion chamber 40.

The various embodiments of the present invention may provide one or more technical advantages over existing late lean injection systems. For example, the systems and methods described herein may reduce variations in the pressure and/or flow of the working fluid 24 through each fuel injector 60. As a result, the various embodiments require less analysis to achieve the desired fuel-air ratio through the fuel injectors 60 and enhance the intended ability of the fuel injectors 60 achieve the desired efficiency and reduced emissions from the combustor 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A system for providing compressed air to fuel injectors within a combustor, the system comprising:

an annular liner defining a combustion chamber within a casing of the combustor;

a flow sleeve assembly having an inner sleeve radially spaced from and circumferentially surrounding the liner, an outer sleeve radially spaced from and circumferentially surrounding the inner sleeve, the inner sleeve being fixedly connected to the outer sleeve and forming a void therebetween, wherein the liner and the inner sleeve define an annular flow passage therebetween, the flow sleeve assembly further comprising a plurality of fuel injectors circumferentially spaced around and extending radially through the outer sleeve, the inner sleeve, the annular flow passage and the liner, each fuel injector having an inlet defined along an outer surface of the outer sleeve;

an upstream end of the flow sleeve assembly directly connected to the casing of the combustor, the outer sleeve, the inner sleeve, and the void therebetween all extending from the upstream end to the plurality of fuel injectors located downstream from the upstream end;

a distribution manifold that extends continuously circumferentially around the outer sleeve, the distribution manifold having a forward wall axially spaced from an aft wall and an outer wall that extends axially between the forward wall and the aft wall, the outer wall substantially parallel with and radially spaced from the outer surface of the outer sleeve, the forward and aft walls being fixedly connected directly to the outer surface of the outer sleeve, wherein the forward wall, the aft wall and the outer wall define an annular flow passage within the distribution manifold and wherein the inlet of each fuel injector is disposed within the annular flow passage; and a plurality of openings circumferentially spaced along the outer wall of the distribution manifold, wherein each opening defines a fluid passage into the annular flow passage, wherein a first portion of an inner surface of the outer wall is radially spaced from the outer surface of the outer sleeve at a first radial height at a first circumferential location along the outer sleeve and a second portion of the inner surface of the outer wall is radially spaced from the outer surface at a second radial height at a second circumferential location along the outer sleeve, the second radial height is greater than the first radial height.

2. The system as in claim 1, wherein each opening is circumferentially offset from a corresponding inlet of a corresponding fuel injector of the plurality of fuel injectors.

3. The system as in claim 1, wherein the forward wall is axially spaced from the aft wall at a first axial distance at a first circumferential location along the outer surface of the outer liner and the forward wall is axially spaced from the aft wall at a second axial distance at a second circumferential location along the outer surface of the outer liner.

4. The system as in claim 3, wherein at least one opening of the plurality of openings is axially offset from a corresponding inlet of a corresponding fuel injector of the plurality of fuel injectors.

5. The system as in claim 1, further comprising a transition duct that extends axially downstream from an aft end of the liner, wherein the liner and the transition duct define a hot gas path through the combustor.

6. A system for providing compressed air to fuel injectors within a combustor, the system comprising:

an annular liner defining a combustion chamber within a casing of the combustor;

a flow sleeve assembly having an inner sleeve radially spaced from and circumferentially surrounding the liner, an outer sleeve radially spaced from and circumferentially surrounding the inner sleeve, the inner sleeve being fixedly connected to the outer sleeve and forming a void therebetween, wherein the liner and the inner sleeve define an annular flow passage therebetween, the flow sleeve assembly further comprising a plurality of fuel injectors circumferentially spaced around and extending radially through the outer sleeve, the inner sleeve, the annular flow passage and the liner, each fuel injector having an inlet defined along an outer surface of the outer sleeve;

an upstream end of the flow sleeve assembly directly connected to the casing of the combustor, the outer sleeve, the inner sleeve, and the void therebetween all extending from the upstream end to the plurality of fuel injectors located downstream from the upstream end;

a distribution manifold that extends continuously circumferentially around the outer sleeve, the distribution manifold having a forward wall axially spaced from an aft wall and an outer wall that extends axially between the forward wall and the aft wall, the outer wall substantially parallel with and radially spaced from the outer surface of the outer sleeve, the forward and aft walls being fixedly connected directly to the outer surface of the outer sleeve, wherein the forward wall, the aft wall and the outer wall define an annular flow passage within the distribution manifold and wherein the inlet of each fuel injector is disposed within the annular flow passage; and a plurality of openings circumferentially spaced along the outer wall of the distribution manifold, wherein each opening defines a fluid passage into the annular flow passage, wherein the forward wall is axially spaced from the aft wall at a first axial distance at a first circumferential location along the outer surface of the outer sleeve and the forward wall is axially spaced from the aft wall at a second axial distance at a second circumferential location along the outer surface of the outer sleeve, the second axial distance is greater than the first axial distance.

7. The system as in claim 6, wherein at least one opening of the plurality of openings is axially offset from a corresponding inlet of a corresponding fuel injector of the plurality of fuel injectors.

8. The system as in claim 6, wherein a first portion of an inner surface of the outer wall is radially spaced from the outer surface of the outer sleeve at a first radial height at a first circumferential location along the outer sleeve and a second portion of the inner surface of the outer wall is radially spaced from the outer surface at a second radial height at a second circumferential location along the outer sleeve.

9. The system as in claim 8, wherein each opening of the plurality of openings is circumferentially offset from a corresponding inlet of a corresponding fuel injector of the plurality of fuel injectors.

10. The system as in claim 6, further comprising a transition duct that extends axially downstream from an aft end of the liner, wherein the liner and the transition duct define a hot gas path through the combustor.

* * * * *